US006155662A

United States Patent [19]

Fookes et al.

[11] Patent Number: 6,155,662

[45] Date of Patent: Dec. 5, 2000

[54] UNIVERSAL WALL SUPPORT FOR A CABINET

[75] Inventors: Tim Fookes, Grandville; Bret Marschand, Grand Rapids; Bryan Roels, Hamilton, all of Mich.

[73] Assignee: Haworth, Inc., Holland, Mich.

[21] Appl. No.: 09/326,193

[22] Filed: Jun. 4, 1999

[51] Int. Cl.[7] ..... A47B 91/00

[52] U.S. Cl. ..... 312/351.1; 248/678; 280/79.11

[58] Field of Search ..... 312/263, 264, 312/265.5, 351.1; 248/346.05, 346.07, 678; 280/79.11

[56] References Cited

U.S. PATENT DOCUMENTS

| | | | |
|---|---|---|---|
| 1,377,824 | 5/1921 | Forbes . | |
| 2,295,915 | 9/1942 | Ring | 312/265.5 X |
| 2,664,258 | 12/1953 | Lanier . | |
| 2,763,491 | 9/1956 | Thorwaldson | 280/79.11 X |
| 3,819,245 | 6/1974 | Tacke . | |
| 4,319,793 | 3/1982 | Suttles | 312/263 X |
| 4,500,146 | 2/1985 | Peterson . | |
| 4,540,222 | 9/1985 | Burrell . | |
| 5,085,396 | 2/1992 | Mansson . | |
| 5,308,037 | 5/1994 | Gonzalez | 248/678 X |
| 5,407,171 | 4/1995 | Gonzalez | 248/678 X |
| 5,415,472 | 5/1995 | Brise . | |
| 5,743,607 | 4/1998 | Teufel et al. | 312/264 X |

*Primary Examiner*—Jose V. Chen
*Assistant Examiner*—Michael J. Fisher
*Attorney, Agent, or Firm*—Flynn, Thiel, Boutell & Tanis, P.C.

[57] ABSTRACT

A universal wall support or frame member is provided which is used to connect laterally spaced apart side walls of a file cabinet or other type of storage cabinet. The universal wall support includes opposite end sections which are telescopingly engaged together so that the wall support may be extended to any desired length and thereafter fixed at a set length such that the universal wall support is usable for different size cabinet constructions. The opposite end sections define a first range of cabinet sizes, and the universal wall support may include an intermediate extender section which slidably joins opposite end sections together so that the universal wall support defines a second range of cabinet sizes. The opposite end sections further include support flanges for supporting the side walls, particularly those made of wood, to further strengthen the file cabinet.

23 Claims, 8 Drawing Sheets

UNIVERSAL WALL SUPPORT FOR A CABINET

FIELD OF THE INVENTION

The invention relates to a wall support or frame member which interconnects and provides rigid support to opposing side walls of a file cabinet or other storage cabinet.

BACKGROUND OF THE INVENTION

In conventional file cabinets and other types of storage cabinets, the individual side walls of the cabinet typically are held together by interior frame members or rectangular base frames. For example, U.S. Pat. No. 3,819 245 discloses a metal rectangular frame to which the separate side walls of a cabinet are connected.

In some storage cabinets, the side walls are made of wood and in particular, include a core which is formed of a manufactured wood material such as particle board and is covered with a wood laminate. It is known to provide wood support rails which extend laterally between a spaced apart pair of side walls.

While the wood rails and the wood side walls can be readily connected together by threaded fasteners such as screws, the joint formed therebetween may still be subject to failure. In particular, the wood support rails typically are supported on the upper ends of glides or casters wherein the weight of the side walls is transferred to the wood rails through the fasteners connected therebetween. If the file cabinet is dropped, the weight of the cabinet is driven downwardly to the fastener and either the side walls or the wood support rails may splinter resulting in failure of the file cabinet.

This is particularly true for storage cabinets having slidable drawers since the drawers typically are supported on the side walls adding further weight to the cabinet. While the wood support rails may alternatively be made of a metal, such failures may still occur since the side walls are still made of wood products.

In addition to the potential for failure, the support rails or base frames typically are formed with a predefined fixed size wherein different size rails or frames are required for different size file cabinets. This results in multiple variations of the same part.

It therefore is an object of the invention to overcome a number of the disadvantages associated with prior file cabinet constructions.

More particularly, the invention relates to a universal wall support or frame member which connects cabinet side walls together, particularly those made of wood. The universal wall support has a telescoping construction which may be extended to any desired length and fixed at a set length such that a single universal wall support is usable for different size cabinet constructions.

The universal wall support includes opposite end sections which are telescopingly engaged together for use with a first range of cabinet sizes, and may include an intermediate extender section which is slidably engaged with a pair of the opposite end sections to permit use with a second range of cabinet sizes.

The opposite end sections further include cantilevered support flanges which project sidewardly to define vertical support surfaces upon which the bottom edges of the side walls are supported. The support flanges provide vertical support to the side walls, for example, when the cabinet is dropped. As a result, the support flanges significantly increase the overall strength of the cabinet.

Other objects and purposes of the invention, and variations thereof, will be apparent upon reading the following specification and inspecting the accompanying drawings.

Figure 1:
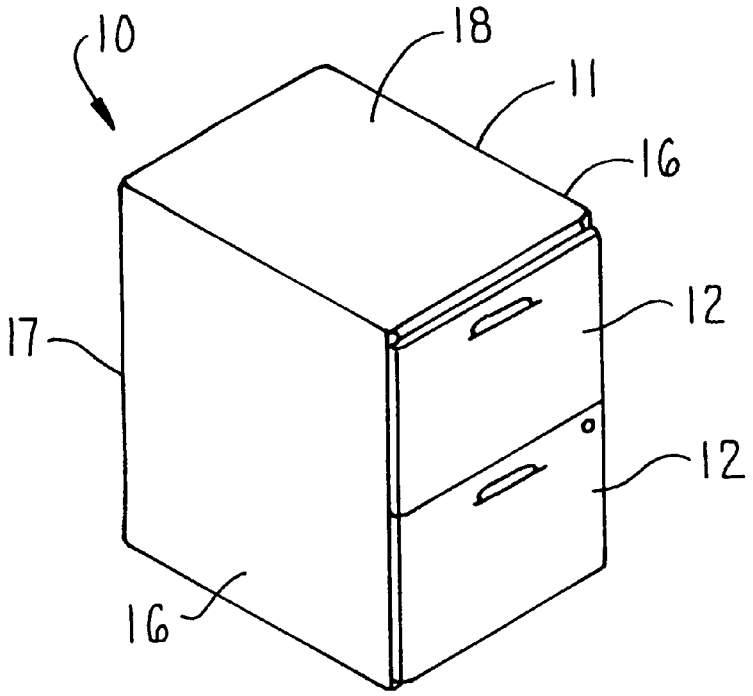
FIG. 1 is a front perspective view of a small file cabinet of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the invention and designated parts thereof. Said terminology will include the words specifically mentioned, derivatives thereof, and words of similar import.

DETAILED DESCRIPTION

Figure 2:
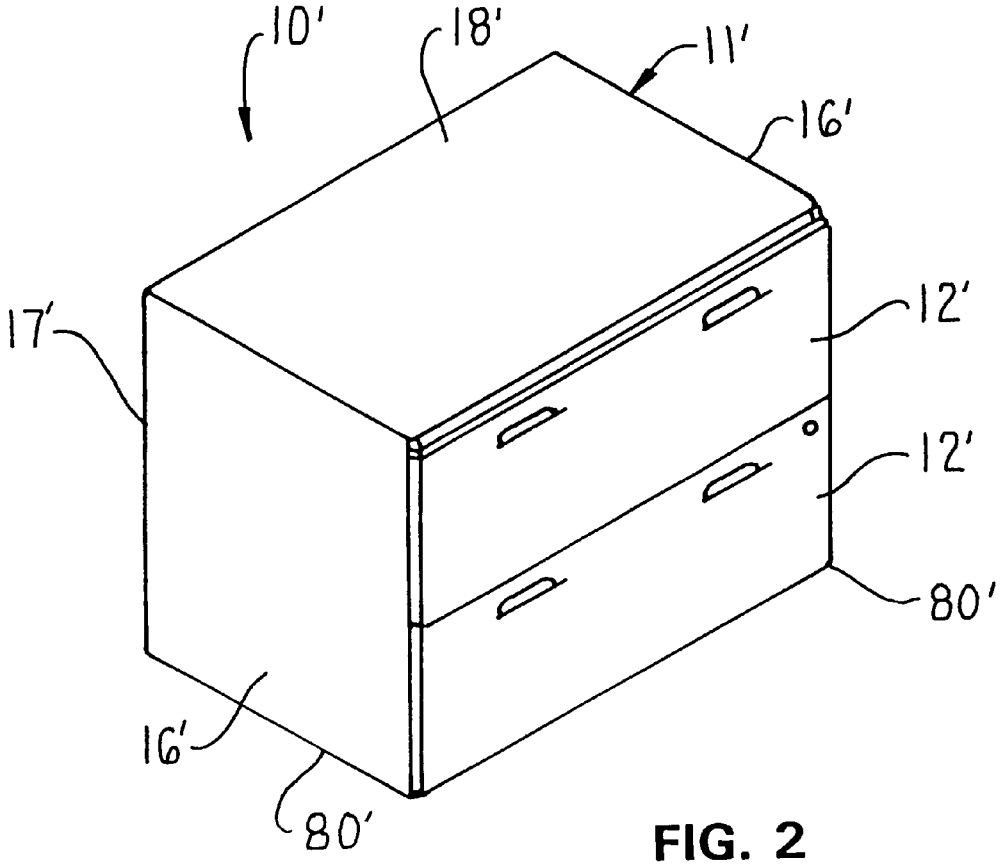
FIG. 2 is a front perspective view of a large file cabinet of the invention.
Figure 3:
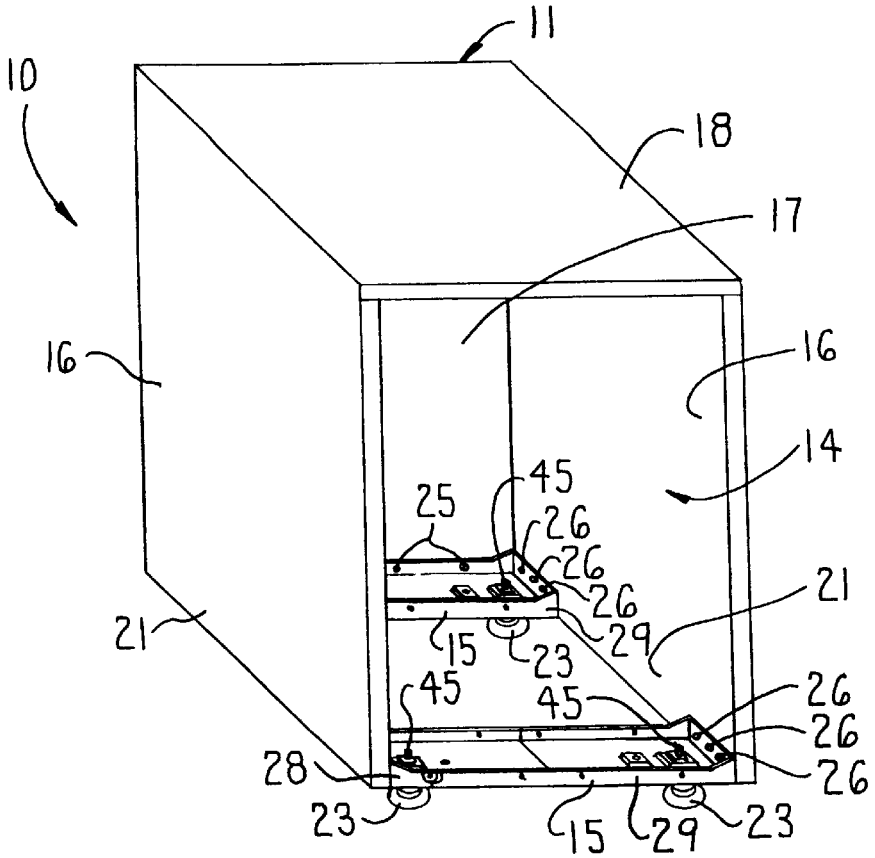
FIG. 3 is a front perspective view of the small file cabinet having the drawers removed to illustrate two universal wall supports disposed in the interior thereof.

Referring to FIG. 1, the invention relates to a storage cabinet 10 that includes an outer enclosure 11 which has an open front side and a pair of drawers 12 slidably received in a hollow interior 14 thereof. FIG. 1 illustrates a small storage cabinet 10, and FIG. 2 illustrates a large storage cabinet 10' which is formed substantially the same as the small storage cabinet 10 except for the lateral width thereof. Referring to FIG. 3, the storage cabinet includes inventive universal wall supports or frame members 15 which provide rigid support to the enclosure 11 as discussed herein.

Generally with respect to the storage cabinet (10'), the enclosure (11') has a box-like shape which is defined by a pair of laterally spaced apart side walls (16'), a rearward facing back wall (17'), and an upward facing top wall (18'). The front edges of the side walls (16') and top wall (18') define a periphery of the open front of the enclosure (11').

The drawers (12') are slidably connected to the side walls (16') in a conventional arrangement such that the side walls bear the weight of the drawers (12'). The drawers 12 and the drawer slides therefor, however, are not depicted in FIGS. 3 and 4 for illustrative purposes.

In the illustrated embodiment, the side walls 16, back wall 17 and top wall 18 are formed of a solid material and typically are formed of a wood material. Although the wood material could be a solid wood panel, the side walls 16, back wall 17 and top wall 18 more typically are formed of a wood material core which is covered with a wood laminate. The wood material core, for example, may be formed of a particle board or other similar rigid material. While the universal wall supports 15 are particularly suitable for use with walls made of a wood material, the walls 16 may also be formed of a metal or plastic material.

Figure 4:
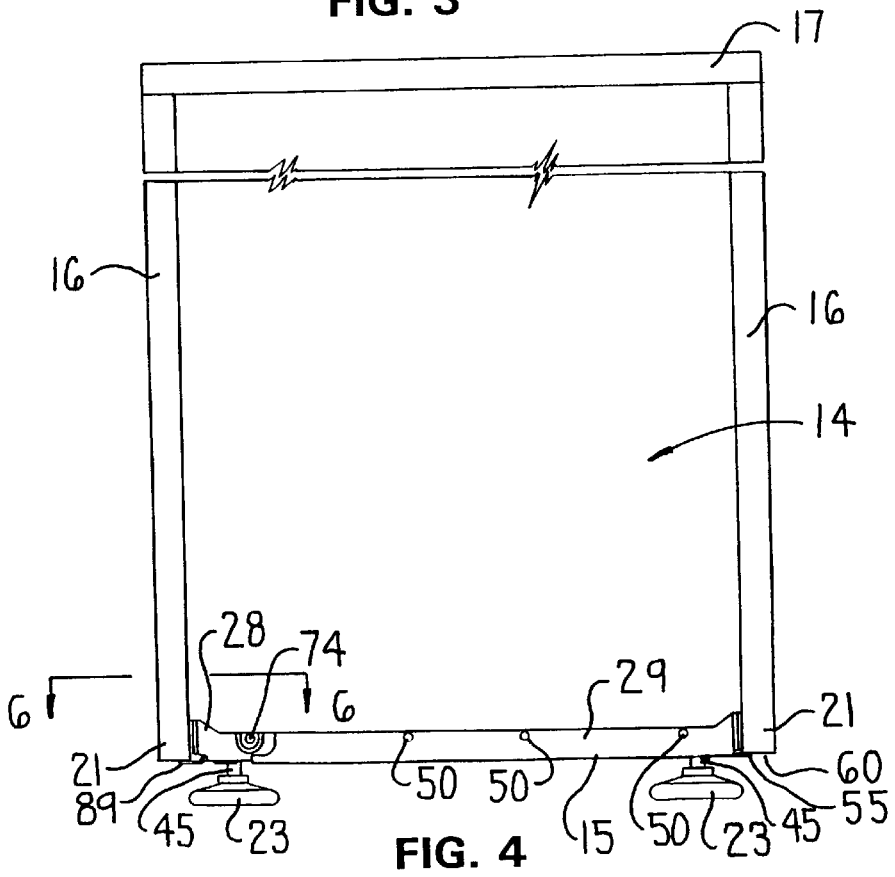
FIG. 4 is a front elevational view of the cabinet of FIG. 3.

Referring to FIGS. 3 and 4, the opposing side walls 16 include bottom sections 21 which are rigidly joined together by the wall supports 15 that extend laterally therebetween. Preferably, a pair of the wall supports 15 are provided wherein the wall supports 15 are spaced rearwardly from each other. The wall supports 15 include furniture glides 23 which project downwardly therefrom into load bearing engagement with a floor, such that the wall supports 15 not only provide lateral support to the side walls 16 but also provide vertical support thereto.

Generally with respect to the connection of the wall supports 15 to the enclosure 11, each universal wall support 15 is connected to the back wall 17 by fasteners 25 and to each side wall 16 by fasteners 26. Where the enclosure 11 is formed of a wood material, the fasteners 25 and 26 are conventional threaded screws or the like. If the universal wall supports 15 were formed of a metal material, the fasteners 25 and 26 would be metal screws or bolts.

With respect to the structure and function of the wall supports 15 illustrated in FIGS. 3–13, the wall supports 15 are used with the small storage cabinet 10 of FIG. 1. Each wall support 15 is defined by pan-shaped end sections 28 and 29 which define the opposite ends 31 and 32 respectively of the wall support 15.

Figure 7:
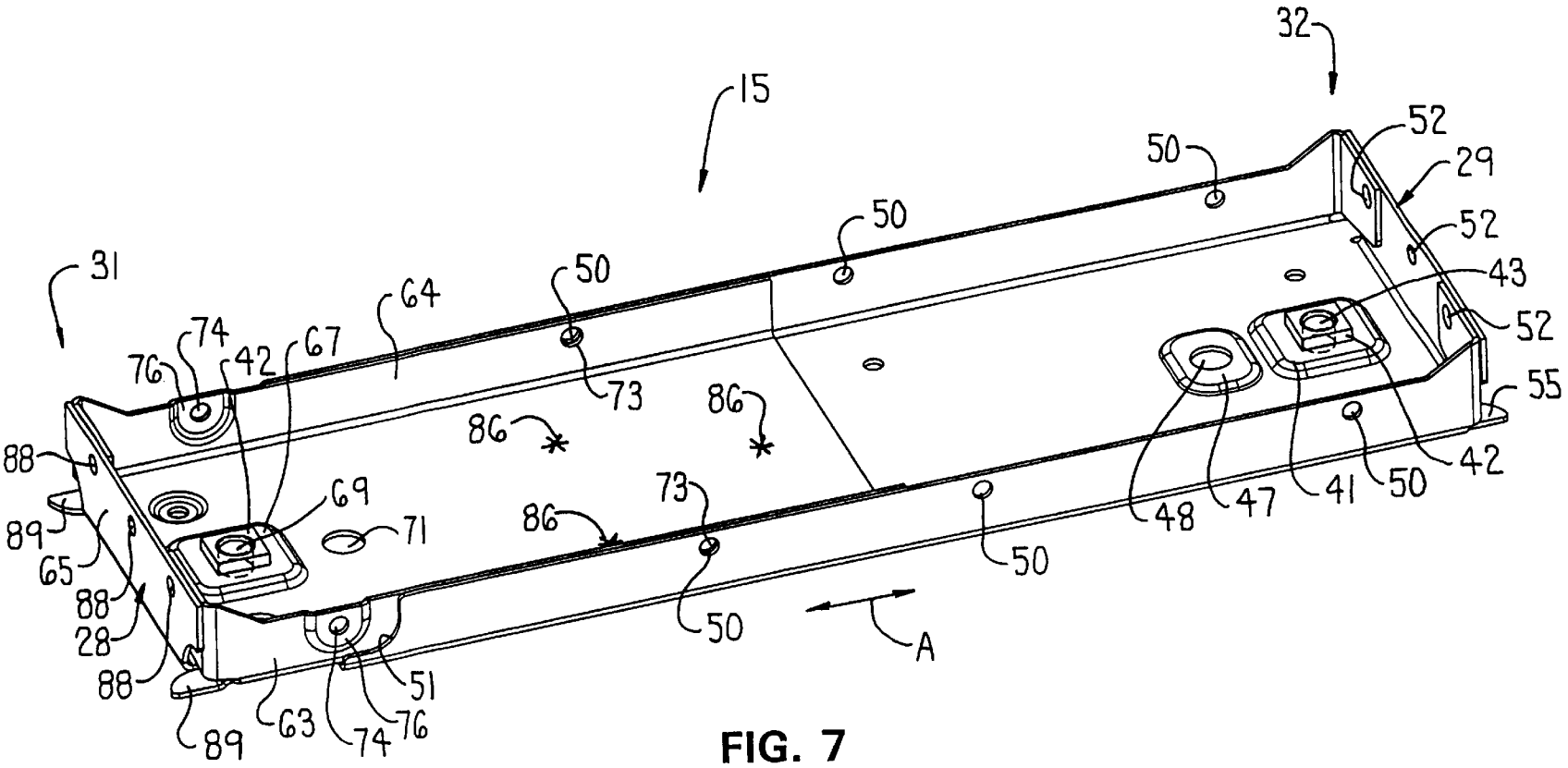
FIG. 7 is a front perspective view of the universal wall support.

Generally, the end sections 28 and 29 are nested together in telescoping engagement wherein the end sections 28 and 29 can be slid inwardly and outwardly relative to each other as generally indicated by reference arrow A in FIG. 7. Relative sliding of the end sections 28 and 29 thereby adjusts the lateral distance between the opposite ends 31 and 32 so as to adjust the overall length defined thereby. While the wall supports 15 of FIG. 3 ultimately are fixed at a set length, the lateral adjustability of the end sections 28 and 29 permits each wall support 15 to be adjusted for use with a first range of cabinet sizes. This lateral adjustability will be discussed in further detail herein with respect to the specific components of the wall support 15.

As illustrated in FIGS. 7–11, the large end section 29 includes a horizontally enlarged bottom wall 35, front and back walls 36 and 37 which project upwardly from the bottom wall 35, and an end wall 38 which projects upwardly from the bottom wall and extends rearwardly from the front wall 36 to the back wall 37. The front wall 36, back wall 37 and end wall 38 define three sides of the end section 29 while the fourth side opens sidewardly to define an open end 40 thereof.

Figure 5:
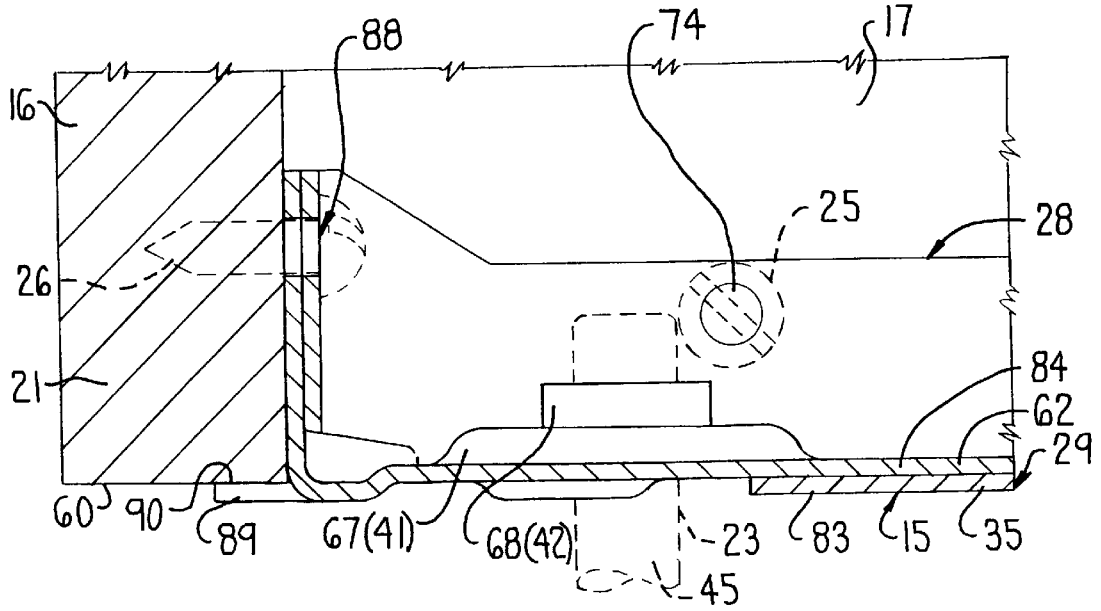
FIG. 5 is a an enlarged front elevational view in cross-section illustrating one end of a universal wall support as taken along line 5—5 of FIG. 8.
Figure 6:
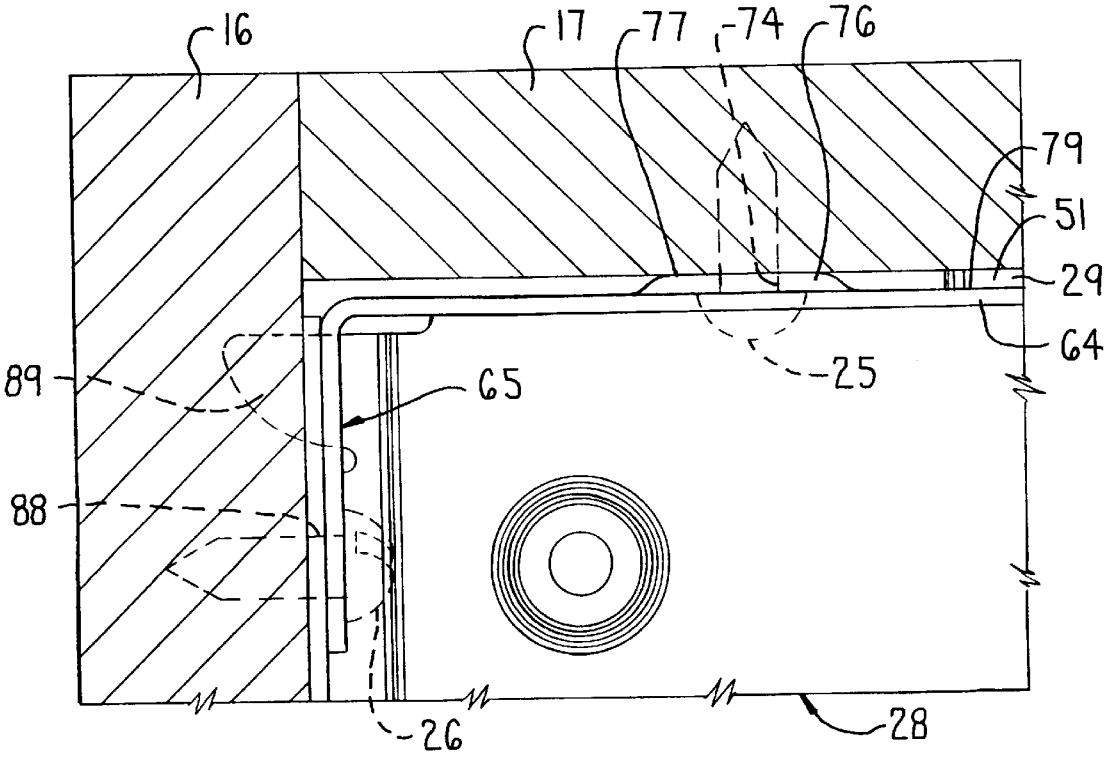
FIG. 6 is an enlarged top view in cross-section illustrating a rear corner connection as taken along line 6—6 of FIG. 4.

As seen in FIGS. 5, 7, 8 and 11, the bottom wall 35 includes an embossed glide mount 41 which opens vertically therethrough and is adapted to be engaged with a corresponding furniture glide 23 (FIG. 5). Each glide mount 41 includes a connector block 42 which is fixed to an aperture formed in the bottom wall 35. The connector block 42 includes a vertical bore 43 (FIGS. 7 and 8) which receives an upper end of a glide stem 45 (FIG. 5) of the glide 23. The stem 45 projects through and vertically supports the wall support 15 wherein the glides 23 vertically support the weight of the storage cabinet 10.

The bottom wall 35 further includes a caster mount 47 which is disposed proximate to the glide mount 41 but is disposed inwardly thereof. The caster mount 47 comprises a vertical bore 48 projecting vertically through the bottom wall 35 which is adapted to receive a stem of a conventional caster or wheel assembly. Thus, the wall supports 15 may alternatively be supported by a plurality of casters (not illustrated) rather than the glides 23.

Figure 13:
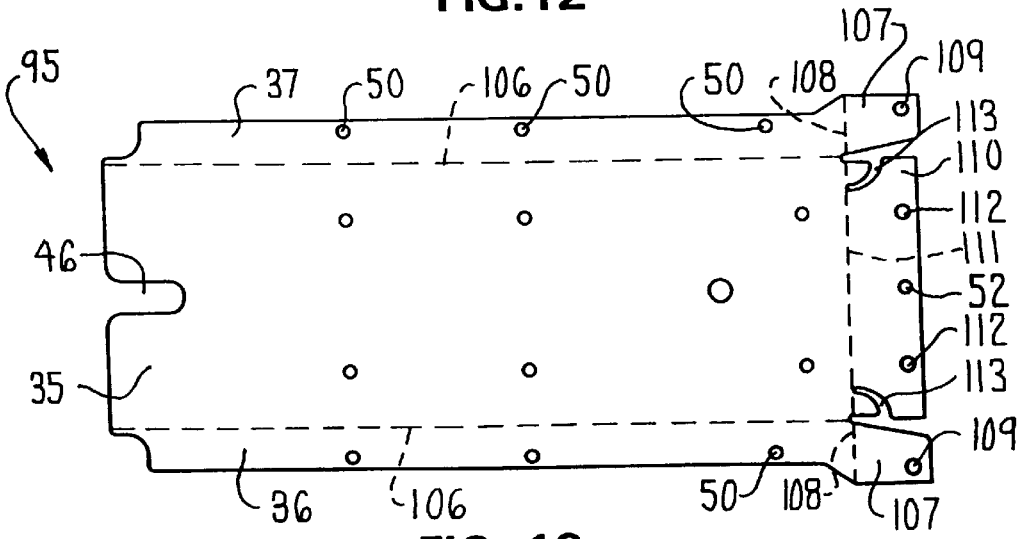
FIG. 13 is a plan view of a blank for a large end section.

To avoid interference between the large end section 29 and the left most caster which would be connected to the small end section 28, the bottom wall 35 of the large end section 29 also includes a stem slot 46 which opens sidewardly as illustrated in FIG. 13. The stem slot 46 is adapted to receive the stem of the left most caster therein when the small and large end sections 28 and 29 are in the fully retracted position of FIGS. 3 and 4.

Figure 9:
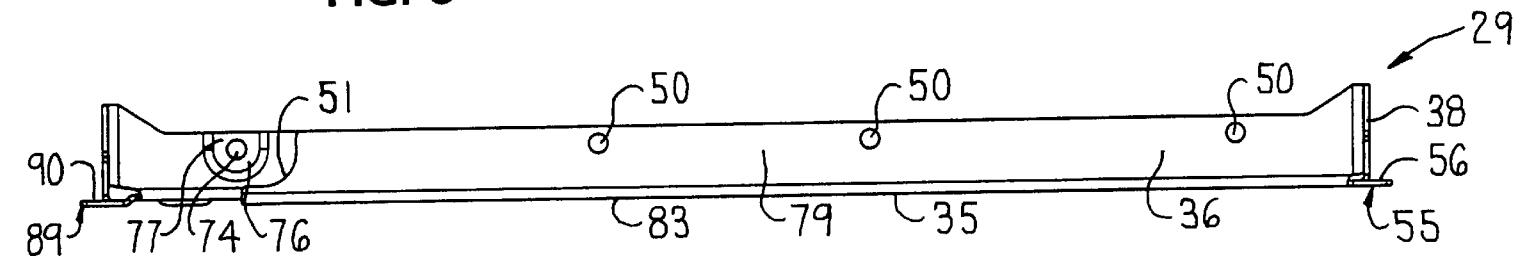
FIG. 9 is a front elevational view of the universal wall support.
Figure 10:
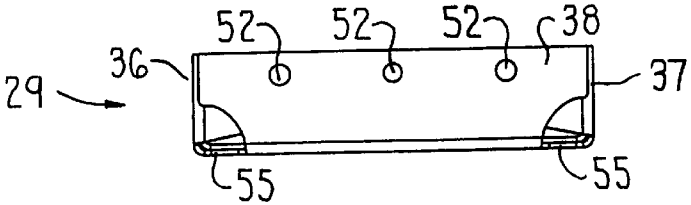
FIG. 10 is a right end view of the universal wall support.
Figure 11:
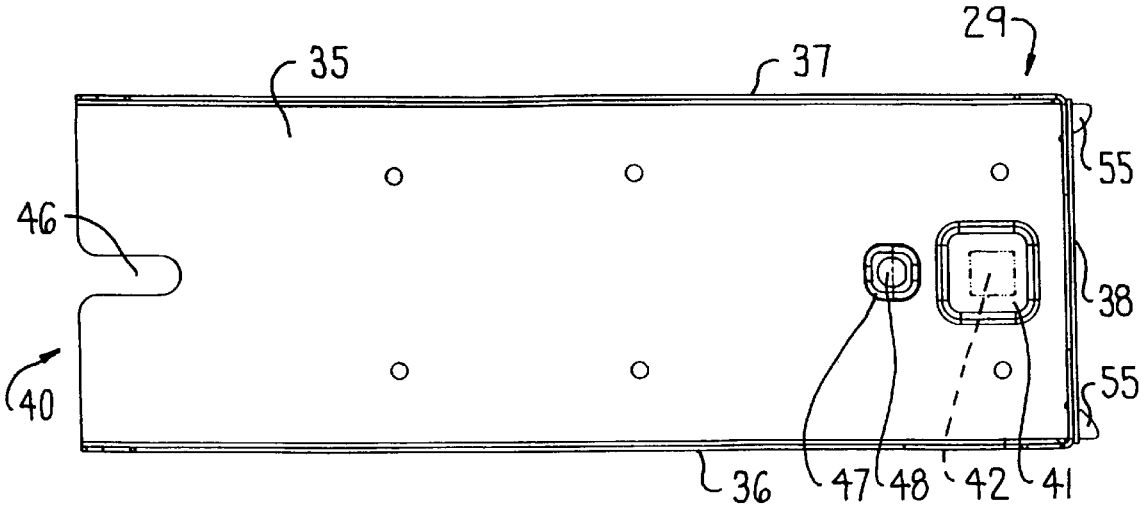
FIG. 11 is a plan view of a tray-like right end section of the wall support.

Each of the front and back walls 36 and 37 also includes a plurality and preferably three laterally spaced apart fastener holes 50 which open horizontally therethrough. The fastener holes 50 in the back wall 37 are adapted to receive the back fasteners 25 therethrough such as when a rear most wall support 15 abuts against the back cabinet wall 17 as generally illustrated in FIG. 3. End edges 51 of the front and back walls 36 and 37 are disposed proximate the open end 40 and are curved as illustrated in FIG. 7 and 9.

To fasten the end wall 38 to a respective side wall 16, the end wall 38 includes a plurality and preferably three fastener holes 52 which open sidewardly therethrough. The fastener holes 52 are adapted to receive the side fasteners 26 therethrough wherein the side fasteners 26 threadedly engage the respective side wall 16 as seen in FIGS. 3 and 4.

The large end section 29 further includes at least one and preferably two cantilevered support tabs or flanges 55 which project sidewardly from the bottom wall 35. The support tabs 35 project outwardly of the end walls 38 and define upward facing support surfaces 56 so that a bottom edge 60 of a respective side wall 16 is supported vertically thereby.

The small end section 28 is formed very similar to the large end section 29 except that the small end section 28 is adapted to be slidably received within the open end 40 of the end section 29. More particularly, the end section 28 has a similar pan-shape defined by a horizontally enlarged bottom wall 62, upstanding front and back walls 63 and 64, and a sideward facing end wall 65.

The bottom wall 62 is formed with an embossed glide mount 67 having a connector block 68 fixed thereto. The connector block 68 is formed identical to the connector block 42 discussed previously wherein the connector block 68 includes a vertical bore 69 which receives the stem 45 of a glide 23. As such, the small end section 28 is supported vertically on an upper end of the left most glide 23 corresponding thereto. The bottom wall 62 also includes a caster bore 71 which allows a conventional caster to be connected to the end section 28 rather than a furniture glide 23.

Each of the front and back side walls 63 and 64 includes an inner fastener hole 73 which aligns with an innermost one of the fastener holes 50 of the end section 29. Further, the side walls 63 or 64 each include an outer fastener hole 74 which opens horizontally through a raised or embossed portion 76 which projects rearwardly. The raised portion 76 defines an outward facing outer surface 77 which is disposed substantially coplanar with an outer surface 79 (FIG. 6) of the large end section 29 so that an adjacent wall such as the back cabinet wall 37 abuts against both of the outer surfaces 77 and 79.

While the back walls 37 and 64 of the rear most universal wall support 15 are the only wall sections which typically abut against the back cabinet wall 17, the back walls 37 and 64 and front walls 36 and 63 of both file supports 15 are provided with the same arrangement of apertures 50, 73 and 74 such that each wall support 15 is non-handed and reversible. Thus, each wall support 15 can be used in either the front most position or rear most position (FIGS. 3) and also can be reversed left to right such that a large end section 29 can be engaged with either the right side wall 16 as illustrated or the left side wall 16 if desired.

Figure 8:
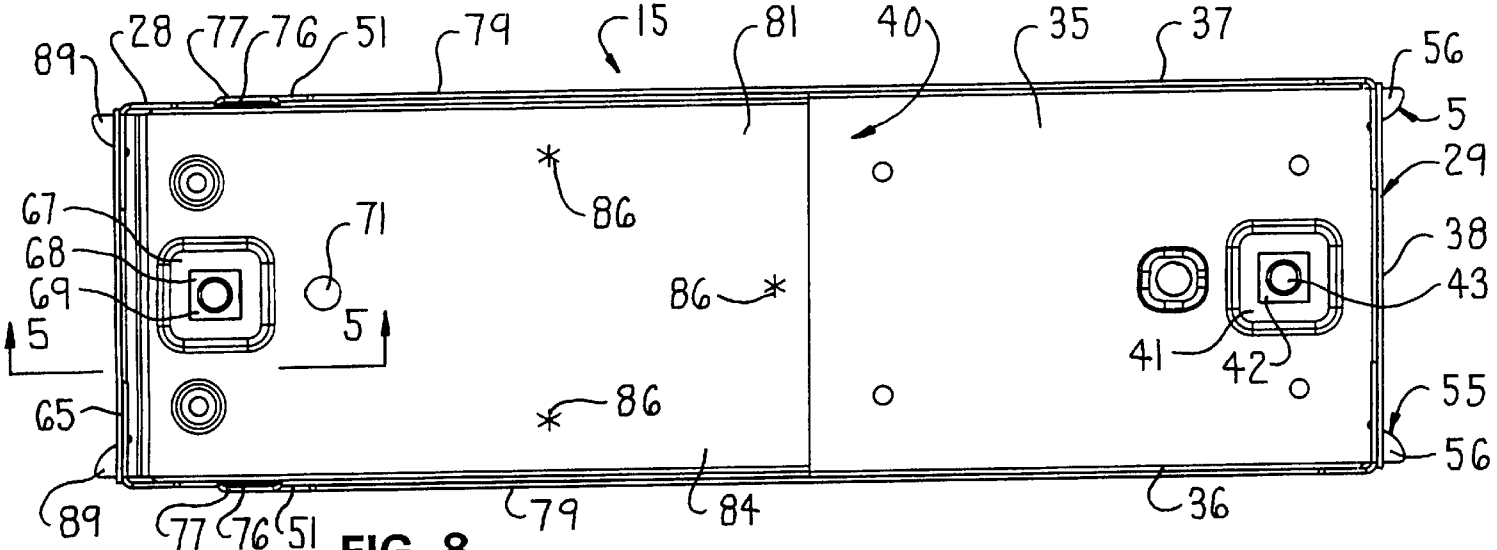
FIG. 8 is a top view in of the universal wall support.

As illustrated in FIGS. 7 and 8, the front and back walls 63 and 64 of the small end section 28 are spaced apart a distance in the front-to-back direction which is less than but proximate to the distance between the front and back walls 36 and 37 of the large end section 29. As such, the inner end 81 of the small end section 28 is slidably received within the open end 40 of the large end section 29. The small and large end sections 28 and 29 thereby are telescopically engaged with each other to adjust the relative positions therebetween. The respective bottom walls 35 and 62 of the large and small end sections 28 and 29 thereby include overlapping sections 83 and 84 which lie one below the other as illustrated in FIGS. 5 and 8.

The magnitude of the area of the overlapping sections 83 and 84 varies depending upon the extent that the small and large end sections 28 and 29 are extended or retracted. During assembly, the small and large end sections 28 and 29 can be adjusted laterally relative to each other in the direction of arrow A to vary the length of the wall support 15.

Preferably during assembly, the small and large end sections 28 and 29 are placed in a jig having laterally spaced apart stops. The stops are set at a distance corresponding to a distance between the side walls of a particular size storage cabinet 10. Once the lateral length of the universal wall support 15 is set, such as in the jig, the small and large end sections 28 and 29 are fastened together to define a set length for the universal wall support 15. Preferably, the end sections 28 and 29 are spot welded together as indicated in FIG. 8 by spot welds 86.

Other manual locks such as fasteners or cam locks also may be used. Such manual locks would permit on site adjustment of the length.

To connect the small end section 28 to the respective cabinet side wall 16, the end wall 65 is formed substantially the same as the end wall 38 wherein the end wall 65 includes a plurality and preferably three fastener holes 88 which open sidewardly. The fastener holes 88 are adapted to receive fasteners 26 horizontally therethrough.

To vertically support the side wall 16, the small end section 28 also includes at least one and preferably two support tabs 89 which vertically support the bottom edge 60 of the respective side wall 16 thereon. In particular, the support tabs 89 define upward facing support surfaces 90 for the bottom edge 60.

As a result, the weight of the entire enclosure 11 and any drawers 12 connected thereto is transferred vertically to the support tabs 55 and 89 on which the side walls 16 are supported. This substantially reduces if not eliminates vertical loads being applied to the fasteners 26 such as when the storage cabinet 10 is dropped. More particularly, if the storage cabinet 10 is inadvertently dropped, the weight of the enclosure 11 is applied to the tabs 55 and 89 rather than the fasteners 26 to effectively resist splitting of the side walls 16 and avoid failure of the joint between the side walls 16 and the wall supports 15.

To further strengthen the connection therebetween, the end walls 38 and 65 preferably have a multilayer construction. More particularly, the end sections 28 and 29 preferably are formed from sheet-like metal blanks or cutouts which are folded into the desired shape.

Figure 12:
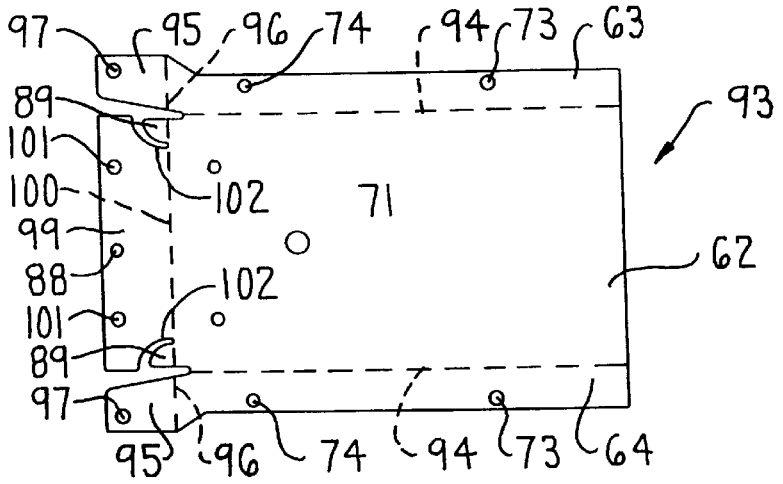
FIG. 12 is a plan view of a sheet metal blank for a small end section.

Referring to FIG. 12, the blank 93 for the small end section 28 is formed with the front and back walls 63 and 64 being joined to a centrally located bottom wall 62 by lateral fold lines 94. Each of the front and back walls and 63 and 64 also includes a corner flange 95 which projects sidewardly therefrom and is joined thereto by a corner fold line 96. Each corner flange 95 includes a hole section 97.

The end wall 65 is defined by a generally rectangular end section 99 which is joined to the bottom wall 62 by an end fold line 100. The end fold line 100 is generally co-linear with the corner fold lines 96. The end section 99 includes hole sections 101 and is separated from the support tabs 89 by arcuate cutlines 102.

During assembly, the end section 99 is folded upwardly about the end fold line 100 while the walls 63 and 64 are themselves folded upwardly above the respective lateral fold lines 94. Thereafter, the corner flanges 95 are folded sidewardly toward the end section 99 about the respective corner fold lines 96 such that the corner flanges 95 are disposed in opposing abutting relation with the end section 99, at which time the corner hole sections 97 are disposed in registry with the corresponding hole sections 101.

As a result, each corner hole section 97 and the aligned hole section 101 defines one of the end fastener holes 88. Further, the corner flanges 95 and end section 99 thereby define multiple layers for the end wall 65 in the corners thereof which further strengthens the connection between the end section 28 and the respective side wall 16.

The large end section 29 is formed in a similar manner to the small end section 28. In particular, the large end section 29 is formed from a sheet-like metal blank 105 wherein the front and back walls 36 and 37 are joined to the central bottom wall 35 by lateral fold lines 106. The walls 36 and 37 include corner flanges 107 which are joined thereto by corner fold lines 108 and include hole sections 109.

The end wall 38 is defined by an end section 110 which projects sidewardly from the bottom wall 35 and is joined thereto by the end fold line 111. The end section 110 includes hole sections 112 and a center fastener hole 52 which is disposed between the hole sections 112. The end section 110 is separated from the support flanges 55 by arcuate cutlines 113. The blank 105 is folded the same as the blank 93 wherein the end wall 38 has multiple material layers in the corners and the hole sections 109 and 112 are aligned in registry to define a corresponding one of the fastener holes 52.

Figure 14:
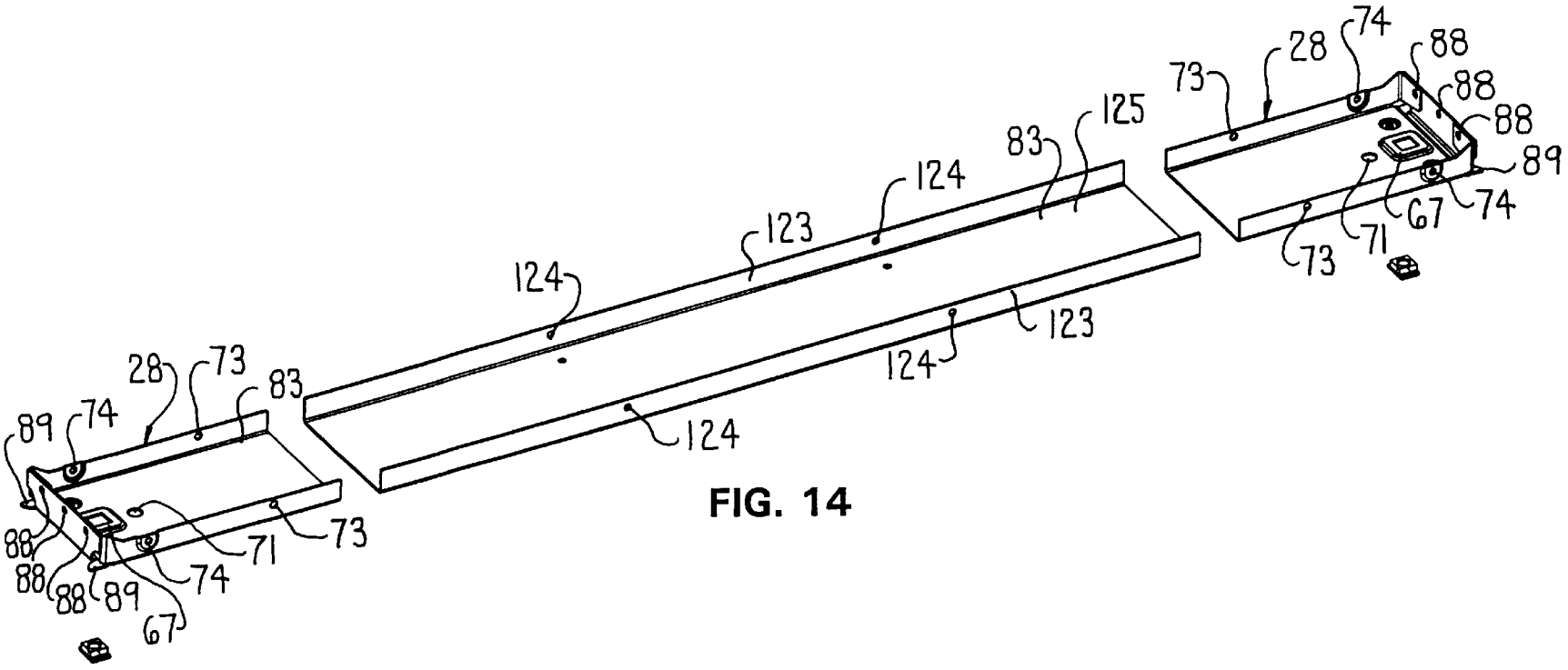
FIG. 14 is an exploded perspective view of a second embodiment of the universal wall support for the large file cabinet of FIG. 2.
Figure 15:
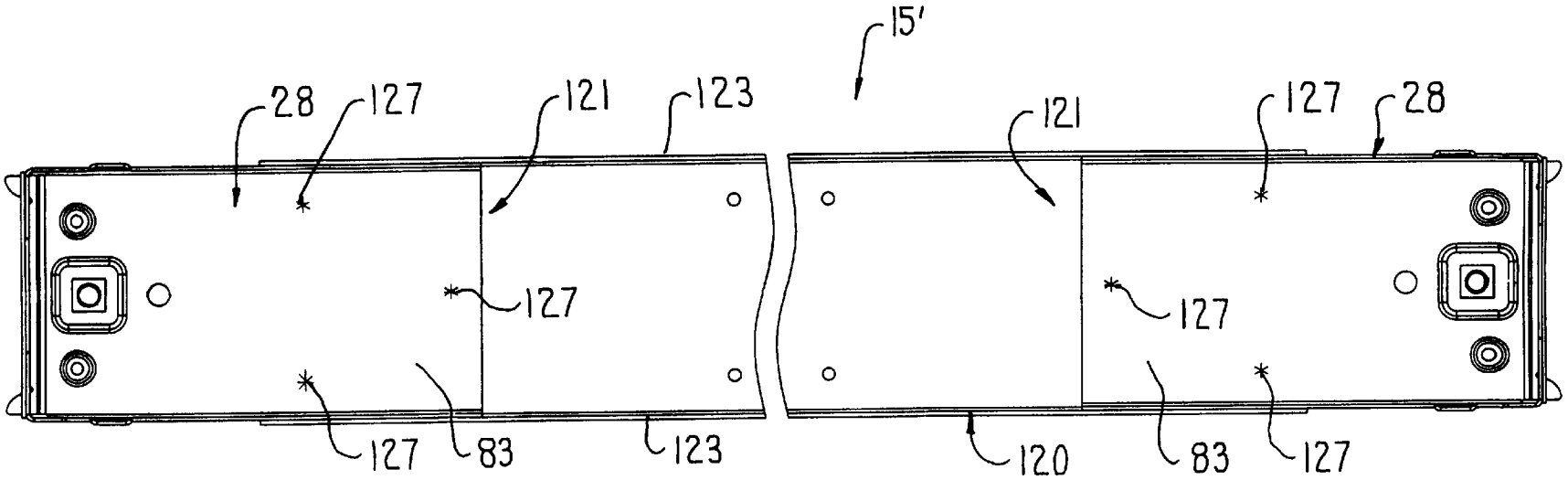
FIG. 15 is a plan view of the universal wall support of FIG. 14.
Figure 16:
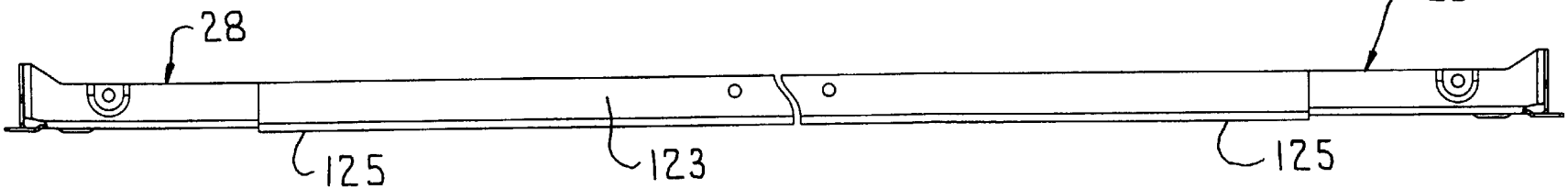
FIG. 16 is a front elevational view thereof.

The universal wall support 15 of FIGS. 3–13 is a first embodiment wherein this first embodiment defines a first range of storage cabinet sizes on which the universal wall support 15 is usable. FIGS. 14–16 further illustrate a second embodiment and in particular, illustrate a universal wall support 15' which is usable with a second range of storage cabinet sizes.

More particularly, the universal wall support 15' is constructed of two small end sections 28 which fit within an extender section 120 and are slidably engaged therewith. The extender section 120 is a U-shaped channel having opposite open ends 121.

The extender section 120 is defined by a horizontally enlarged bottom wall and upstanding front and back walls 123. The front-to-back distance between the walls 123 is larger than but proximate to the distance between the front and back walls 63 and 64 of the end sections 28. As a result, the end sections 28 can be slid into and out of the open ends 121 of the extender section 120 and if desired, the end sections 28 can be moved independently of each other so as to be extended or retracted a different amount.

Each of the end sections 28 thereby has an overlapping section 83 which overlies a corresponding section 125 of the extender section 120. The overlapping sections 83 and 125 are varied as the end sections 28 are moved into and out of the extender section 120 until a desired length for the universal wall support 15' is set. Thereafter, the separate sections 123 and 28 are fastened together preferably by spot welds 127.

The longitudinal length of the universal wall support 15' thereby can be extended and then set at a fixed length to accommodate a second range of sizes for the storage cabinet 10' (FIG. 2). Still further, multiple modular lengths of the extender section 120 may be provided to define additional ranges of cabinet sizes with which the universal wall supports can be used.

The side walls 123 further include fastener holes 124 so that additional fasteners 25 can be inserted therethrough into threaded engagement with an adjacent back wall 17. Other than the length, the universal wall support 15' is structurally and functionally the same as the universal wall support 15 such that the preceding discussion of the universal wall support 15 is equally applicable to the modified wall support 15'.

In view of the foregoing, the invention relates to a wall support system which includes three component parts. In particular, the component parts include the small end section 28, the large end section 29 and the extender section 120. A small end section 28 and a large end section 29 may be telescopingly engaged together and fixed at a set length to define one configuration as illustrated by the universal wall support 15. Alternatively, two small end sections 28 may be provided in combination with an extender section 120 to define a second configuration as illustrated by the universal wall support 15'. The invention thereby permits the side walls 16 of effectively any size storage cabinet to be joined laterally together by the universal wall support.

In operation, selected components of the system of the invention are selected for use. For example, a small end section 28 and large end section 29 may be slidably joined together, or else, a pair of small end sections 28 may be slidably joined to the extender section 120. Thereafter, these components are slid to a set length and fixedly set at this length such as by spot welding. Then, the universal wall supports 15 or 15' are fastened to the side wall 16 or 16' while the rear most wall support 15 or 15' is further connected to the back wall 17 or 17' by suitable fasteners 125. As a result, the bottom side wall edges 80 or 80' are joined together by the respective wall support 15 or 15'. The wall support thereby serves to rigidly join the side walls 16 or 16' together and also provides vertical support to the side walls since the bottom edges 80 or 80' are supported directly on the support flanges 55 and 89.

While a single universal wall support 15 or 15' may be used to join a pair of cabinet components together, two of the universal wall supports 15 or 15' preferably are provided in rearwardly spaced relation. Each of the universal wall supports is connected to and supported by a pair of glides 23 or other suitable support members. Two rearwardly spaced universal wall supports 15 or 15' thereby provide four support members by which the storage cabinet 10 or 10' is supported.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. In a storage cabinet that includes a hollow enclosure which opens from one side thereof, said enclosure being defined by at least a pair of vertically enlarged cabinet side walls which are laterally spaced apart, said cabinet side walls having bottom sections which are joined together by a frame structure, comprising the improvement wherein said frame structure comprises at least one universal wall support which extends laterally between said bottom sections of said cabinet side walls and has a lateral length which is adjustable to accommodate different size storage cabinets, said universal wall support comprising at least first and second frame sections disposed in slidable telescoping engagement to define the lateral length of said universal wall support, said first and second frame sections including adjacent inner end portions which are disposed in overlapping relation to each other and are fastened together to define a fixed lateral length for said universal wall support which corresponds to a lateral spacing between said bottom sections of said cabinet side walls, said universal wall support having opposite ends which are rigidly connected to said bottom sections of said cabinet side walls to join said cabinet side walls in laterally fixed relation to each other, said bottom sections having interior surfaces which abut against opposing side surfaces of said universal wall support at said opposite ends to prevent inward movement of said bottom sections, and fasteners being provided which engage said bottom sections and said opposite ends together.

2. A storage cabinet according to claim 1, wherein said overlapping end portions are welded together.

3. A storage cabinet according to claim 1, wherein said universal wall support includes support projections which project sidewardly into vertical supportive engagement with a respective one of said cabinet side walls, said bottom sections of said cabinet side walls including downward facing support surfaces which are supported vertically by said support projections such that said support projections support a weight of said cabinet side walls.

4. A storage cabinet according to claim 3, wherein said support projections are defined by horizontally elongate tabs which are disposed below a lower edge of said cabinet side walls.

5. A storage cabinet according to claim 3, wherein said universal wall support includes vertical support members which project downwardly therefrom into load bearing engagement with a floor such that said universal wall support is spaced upwardly above the floor.

6. A storage cabinet according to claim 5, wherein said side walls include drawers supported thereon wherein a weight of said drawers is supported vertically by said support projections through said cabinet side walls.

7. A storage cabinet according to claim 1, wherein said first and second frame sections define said opposite ends of said universal wall support which are connected to said cabinet side walls.

8. In a storage cabinet that includes a hollow enclosure which opens from one side thereof, said enclosure being defined by at least a pair of vertically enlarged cabinet side walls which are laterally spaced apart, said cabinet side walls having bottom sections which are joined together by a frame structure, comprising the improvement wherein said frame structure comprises at least one universal wall support which extends laterally between said bottom sections of said cabinet side walls and has a lateral length which is adjustable to accommodate different size storage cabinets, said universal wall support comprising at least first and second frame sections disposed in slidable telescoping engagement to define the lateral length of said universal wall support, said first and second frame sections including adjacent inner end portions which are disposed in overlapping relation to each other and are fastened together to define a fixed lateral length for said universal wall support which corresponds to a lateral spacing between said bottom sections of said cabinet side walls, said universal wall support having opposite ends which are rigidly connected to said bottom sections of said cabinet side walls to join said cabinet side walls in laterally fixed relation to each other, each of said first and second frame sections including a bottom wall and front and back frame side walls which project upwardly therefrom, said frame side walls of said first end section being disposed between said frame side walls of said second frame section such that said first and second frame sections are slidably nested together.

9. In a storage cabinet that includes a hollow enclosure which opens from one side thereof, said enclosure being defined by at least a pair of vertically enlarged cabinet side walls which are laterally spaced apart, said cabinet side walls having bottom sections which are joined together by a frame structure, comprising the improvement wherein said frame structure comprises at least one universal wall support which extends laterally between said bottom sections of said cabinet side walls and has a lateral length which is adjustable to accommodate different size storage cabinets, said universal wall support comprising at least first and second frame sections disposed in slidable telescoping engagement to define the lateral length of said universal wall support, said first and second frame sections including adjacent inner end portions which are disposed in overlapping relation to each other and are fastened together to define a fixed lateral length for said universal wall support which corresponds to a lateral spacing between said bottom sections of said cabinet side walls, said universal wall support having opposite ends which are rigidly connected to said bottom sections of said cabinet side walls to join said cabinet side walls in laterally fixed relation to each other, each of said first and second frame sections including upright end walls which are disposed in opposing relation with a respective one of said cabinet side walls, each of said end walls having fastener holes which open horizontally through said end wall and fasteners being provided which extend horizontally through said fastener holes into fixed engagement with said cabinet side walls.

10. A storage cabinet according to claim 9, wherein each of said frame side walls includes a respective corner flange which extends away from said respective frame side wall, each of said end walls being defined by an end flange projecting upwardly from said bottom wall and said corner flanges which are disposed in facing relation with said end flange whereby said corner flanges and said end flange define said multiple layers.

11. A storage cabinet according to claim 9, wherein said universal wall support includes a third frame section which is disposed in slidable telescoping engagement with said second frame section for adjusting the lateral length of said universal wall support, said second and third frame sections including adjacent inner end portions which are disposed in overlapping relation to each other and are fastened together to define said fixed lateral length for said universal wall support in combination with said first frame section.

12. A storage cabinet according to claim 11, wherein said first and third frame sections define said opposite ends of said universal wall support which are connected to said cabinet side walls.

13. A storage cabinet according to claim 9, wherein said end walls are defined by multiple layers of a sheet-like frame material.

14. In a storage cabinet that includes a hollow enclosure which opens from one side thereof, said enclosure being defined by at least a pair of vertically enlarged cabinet side walls which are laterally spaced apart, said cabinet side walls having bottom sections which are joined together by a frame structure, comprising the improvement wherein said frame structure comprises at least one universal wall support which extends laterally between said bottom sections of said cabinet side walls and has a lateral length which is adjustable to accommodate different size storage cabinets, said universal wall support comprising at least first and second frame sections disposed in slidable telescoping engagement to define the lateral length of said universal wall support, said first and second frame sections including adjacent inner end portions which are disposed in overlapping relation to each other and are fastened together to define a fixed lateral length for said universal wall support which corresponds to a lateral spacing between said bottom sections of said cabinet side walls, said universal wall support having opposite ends which are rigidly connected to said bottom sections of said cabinet side walls to join said cabinet side walls in laterally fixed relation to each other, said first frame section being defined by a sheet-like blank of rigid frame material which is foldable, said blank comprising a rectangular center section, front and back side wall sections which are joined to said center section by respective lateral fold lines, an end wall section projecting sidewardly from said center section and joined thereto by an end fold line, said blank further including at least one horizontal support tab projecting sidewardly from said end fold line and a corner tab projecting sidewardly from each of said side wall sections, said corner tabs being connected to said side wall sections by corner fold lines which are approximately co-linear with said end fold line, said side wall sections being folded upwardly about said respective lateral fold lines to define said frame sidewalls, said end wall section being folded upwardly about said end fold line and said corner tabs being folded about said corner fold lines so as to face toward and abut against said end wall section in opposing relation therewith to define multiple layers of said frame material.

15. A storage cabinet according to claim 14, wherein said end wall section and said at least one support tab are formed from a rectangular section of said frame material and separated from each other by an elongate first cut line.

16. A storage cabinet according to claim 15, wherein said end wall and said corner tabs include apertures which are disposed in registry with each other when in said facing relation.

17. In a storage cabinet which includes a hollow enclosure which is open on one side thereof, said enclosure at least being defined by a pair of vertically enlarged cabinet side walls which are laterally spaced apart from each other, said cabinet side walls having bottom sections which are joined together by a frame structure extending laterally therebetween and said cabinet side walls being formed of a wood material, comprising the improvement wherein said frame structure comprises first and second frame sections which define opposite ends of said frame structure and include a connector flange disposed in opposing relation with said bottom section of said side cabinet wall, said frame structure including threaded fasteners which are engaged with said connector flanges and said bottom sections to join said frame structure to said side cabinet walls, said fasteners being threaded into said wood material to prevent sideward movement of said frame structure relative to said cabinet walls, said frame structure including support members projecting downwardly therefrom in load bearing engagement with a floor wherein said frame structure is raised vertically from the floor, said first and second frame sections including support flanges which project sidewardly therefrom, each of said support flanges defining an upward facing support surface which vertically supports said bottom section of said cabinet side wall thereon, said support flanges being rigid such that a weight of said enclosure is supported on said flanges.

18. A storage cabinet according to claim 17, wherein said cabinet side walls have interior surfaces which abut against the frame structure.

19. In a storage cabinet which includes a hollow enclosure which is open on one side thereof, said enclosure at least being defined by a pair of vertically enlarged cabinet side walls which are laterally spaced apart from each other, said cabinet side walls having bottom sections which are joined together by a frame structure extending laterally therebetween, comprising the improvement wherein said frame structure comprises first and second frame sections which define opposite ends of said frame structure and include a connector flange disposed in opposing relation with said bottom section of said side cabinet wall, said frame structure including connectors which are engaged with said connector flanges and said bottom sections to join said frame structure to said side cabinet walls, said frame structure including support members projecting downwardly therefrom in load bearing engagement with a floor wherein said frame structure is raised vertically from the floor, said first and second frame sections including support flanges which project sidewardly therefrom, each of said support flanges defining an upward facing support surface which supports said bottom section of said cabinet side wall thereon, said support flanges being rigid such that a weight of said enclosure is supported on said flanges, said connector flanges projecting vertically to define frame end walls of said first and second frame sections, said frame end walls including apertures extending horizontally therethrough, and said connectors being inserted horizontally through said apertures into engagement with said cabinet side walls.

20. A storage cabinet according to claim 19, wherein said first and second frame sections include front and back frame walls which project upwardly and each include corner flanges which project toward a corresponding one of said connector flanges in facing relation therewith, said multiple layers of said frame material of said end frame walls being defined by said connector flanges and said opposing corner flanges.

21. A storage cabinet according to claim 19, wherein said first and second frame sections are nested together in slidable telescoping engagement to permit adjustment of the lateral positions of said first and second frame sections relative to each other to adjust the lateral length of said frame structure, said first and second frame sections including overlapping portions which are fixedly secured together to define a set length for said frame structure.

22. A storage cabinet according to claim 19, wherein said frame end walls are defined by multiple layers of a sheet-like material.

23. In a storage cabinet which includes a hollow enclosure which is open on one side thereof, said enclosure at least being defined by a pair of vertically enlarged cabinet side walls which are laterally spaced apart from each other, said cabinet side walls having bottom sections which are joined together by a frame structure extending laterally therebetween, comprising the improvement wherein said frame structure comprises first and second frame sections which define opposite ends of said frame structure and include a connector flange disposed in opposing relation with said bottom section of said side cabinet wall, said frame structure including connectors which are engaged with said connector flanges and said bottom sections to join said frame structure to said side cabinet walls, said frame structure including support members projecting downwardly therefrom in load bearing engagement with a floor wherein said frame structure is raised vertically from the floor, said first and second frame sections including support flanges which project sidewardly therefrom, each of said support flanges defining an upward facing support surface which supports said bottom section of said cabinet side wall thereon, said support flanges being rigid such that a weight of said enclosure is supported on said flanges, said first and second frame sections including front and back frame walls and having overlapping portions which are secured together, one of said overlapping portions being smaller than and fitting into the other of said overlapping portions, said back frame walls being disposed adjacent to but offset rearwardly relative to each other, said enclosure including a cabinet back wall extending laterally between said side walls thereof wherein one of said laterally adjacent back frame walls is disposed in contact with said cabinet back wall and is fastened thereto, and the other of said laterally adjacent back walls includes a projecting portion which projects rearwardly into contact with said cabinet back wall and is fastened thereto.

* * * * *